US007482557B2

(12) United States Patent
Clemens

(10) Patent No.: US 7,482,557 B2
(45) Date of Patent: Jan. 27, 2009

(54) LAMELLA TYPE RADIATOR ELEMENT HAVING FOLDABLE PROJECTIONS AND A NOTCH

(75) Inventor: David Clemens, Kandel/Pfalz (DE)

(73) Assignee: DBK David + Baader GmbH, Kandel/Pfalz (DE)

( * ) Notice: Subject to any disclaimer, the term of this patent is extended or adjusted under 35 U.S.C. 154(b) by 56 days.

(21) Appl. No.: 10/338,988

(22) Filed: Jan. 9, 2003

(65) Prior Publication Data

US 2003/0160043 A1 Aug. 28, 2003

(30) Foreign Application Priority Data

Jan. 15, 2002 (EP) ..... 02000889

(51) Int. Cl.
*H05B 3/06* (2006.01)

(52) U.S. Cl. ..... 219/530; 219/540; 219/542

(58) Field of Classification Search ..... 219/530, 219/504, 505, 202, 534–536, 538–539, 520, 219/200; 72/379.2; 174/138 J
See application file for complete search history.

(56) References Cited

U.S. PATENT DOCUMENTS 4,990,748 A 2/1991 Starck
5,471,034 A * 11/1995 Kawate et al. ..... 219/485
5,995,711 A * 11/1999 Fukuoka et al. ..... 392/347
6,259,075 B1 * 7/2001 Wu ..... 219/540
6,472,645 B1 10/2002 Bohlender

FOREIGN PATENT DOCUMENTS

| | | | |
|---|---|---|---|
| EP | 0575649 | | 12/1993 |
| GB | 2197810 | A * | 6/1988 |
| GB | 2322275 | | 8/1998 |
| JP | 54014360 | A * | 2/1979 |
| JP | 7019781 | | 1/1995 |
| JP | 9196583 | | 7/1997 |
| JP | 11344262 | | 12/1999 |

* cited by examiner

*Primary Examiner*—Tu B Hoang
*Assistant Examiner*—Vinod D Patel
(74) *Attorney, Agent, or Firm*—Michael Best & Friedrich LLP

(57) ABSTRACT

A radiator element for an air heating device, and a corresponding heating device and manufacturing method are provided which reveal improved assembly properties. The radiator element comprises at least one lamella element and one radiator sheet, wherein the radiator sheet comprises on at least two edges projections for attaching the lamella element onto the radiator sheet. The projections may be folded for attaching the lamella element. For facilitating the bending process, a notch along the edge is provided.

11 Claims, 9 Drawing Sheets

LAMELLA TYPE RADIATOR ELEMENT HAVING FOLDABLE PROJECTIONS AND A NOTCH

BACKGROUND OF THE INVENTION

1. Field of the Invention

The present invention relates to heating devices and radiator elements which are part of the heating device. The invention further relates to corresponding manufacturing processes. The invention particularly relates to heating devices that are used for heating air.

2. Description of the Related Art

In motor vehicles, particularly those having fuel consumption optimized combustion engines, heating devices or radiators are used for heating the passengers compartment and the engine. However, heating devices are also suitable for other purposes of use in a wide area of application, e.g. in the household installation (air conditioning), industrial plants etc.

Usually, heating devices, in particular heating devices having PTC (Positive Temperature Coefficient) heating elements (i.e. PTC resistors) have radiator elements serving for providing a heat flow for cooling. The heat transfer is often supported by an air flow generated by a blower.

Radiator elements of this type are known to exist in different forms. Many conventional radiator elements for instance comprise lamellae that are fixed by soldering to holding sheets or cover sheets or that are attached to these sheets in a different way. The manufacturing of soldered designs does, however, require great effort and is also not reliable with respect to its processing since it often occurs that not all contact points of the lamellae are soldered on and a regular heat flow transport does therefore not take place.

This may affect the thermal output of the (PTC) radiator to such a great extent that the radiator can no longer be operated within the predefined specification.

As an alternative to the soldered radiator elements, mechanical fixings such as clamping connections are also known. However, these connections reveal the disadvantage that the installation of such radiator elements or the radiator is expensive and error prone.

A radiator is known from EP 0 575 649 B1 which contains heating elements composed to form prefabricated units, where the heating elements consist of sheet strips joined by riveting which include a lamella strip. The PTC elements used are held in windows or break-through openings of plastic frames. For installation, the prefabricated heating element units and the plastic frames provided with the PTC elements are laminated and fixed by means of a support frame. This component reveals the disadvantage that the installation of a radiator of this type is costly.

DE 197 06 199 A1 also describes an electric heating means, in which the heating elements with corrugated ribs carrying PTC elements are laminated. Projections on the sheets serve for securing the position of the corrugated ribs between the heating elements, said sheets bordering the PTC elements. This measure does also not lead to an improved assembly.

EP 0 379 873 A2 describes a device for heating gases by using PTC elements that are set in a frame member which is encompassed by a U-profile and that is covered by a cover plate. Lamellae are arranged in a frictionally tight manner on the arrangement for discharge of heat to the surrounding air, said Lamellae having a breakthrough for this purpose. Although heating units are thereby created on which thermal output elements are arranged, a device of this type can, however be assembled in a costly manner only, since the lamellae have to be slip on separately. Moreover, the arrangement is less stable and cannot easily be laminated.

EP 1 061 776 A1 describes a heating device for heating the air, which comprises position frames with means for the snap-tight locking of radiator elements and electrode sheets. The position frames thereby enable the joining to form radiator units, which can subsequently be laminated or stacked. PIG elements are used as heating elements. Crimp brackets serve for attaching lamellae elements to radiator sheets.

SUMMARY OF THE INVENTION

Given the disadvantages of the various prior art techniques, an improved heating element and a corresponding radiator element and manufacturing method are provided that may show improved assembly properties.

In one embodiment, a radiator element comprises at least one lamella element (or corrugated rib element) and a radiator sheet (or holding sheet), wherein the radiator sheet comprises projections on at least two edges for fixing the lamella element to the radiator sheet. The projections are adapted to be folded for fixing the lamella element, and the projections have a notch along the edge for facilitating the folding process.

In another embodiment, a heating device for heating air is provided. The heating device comprises a radiator element that comprises at least one lamella element and a radiator sheet wherein the radiator sheet comprises projections on at least two edges for fixing the lamella element to the radiator sheet. The projections are adapted to be folded for fixing the lamella element, and the projections have a notch along the edge for facilitating the folding process.

In yet another embodiment, a manufacturing method is provided that comprises the provision of at least one lamella element and of a radiator sheet, which has projections on at least two edges for fixing the lamella element to the radiator sheet. At least one notch is formed on the projections along the respective edge, and subsequently the lamella elements is set onto the radiator sheet. Finally, the projections are folded for fixing the lamella element.

BRIEF DESCRIPTION OF THE DRAWINGS

The accompanying drawings are incorporated into and form a part of the specification for the purpose of explaining the principles of the invention. The drawings are not to be construed as limiting the invention to only the illustrated and described examples of how the invention can be made and used. Further features and advantages will become apparent from the following and more particular description of the invention, as illustrated in the accompanying drawings, wherein.

DETAILED DESCRIPTION OF THE INVENTION

The illustrative embodiments of the present invention will now be described with reference to the figure drawings wherein like elements and structures are indicated with like reference numbers.

Figure 1:
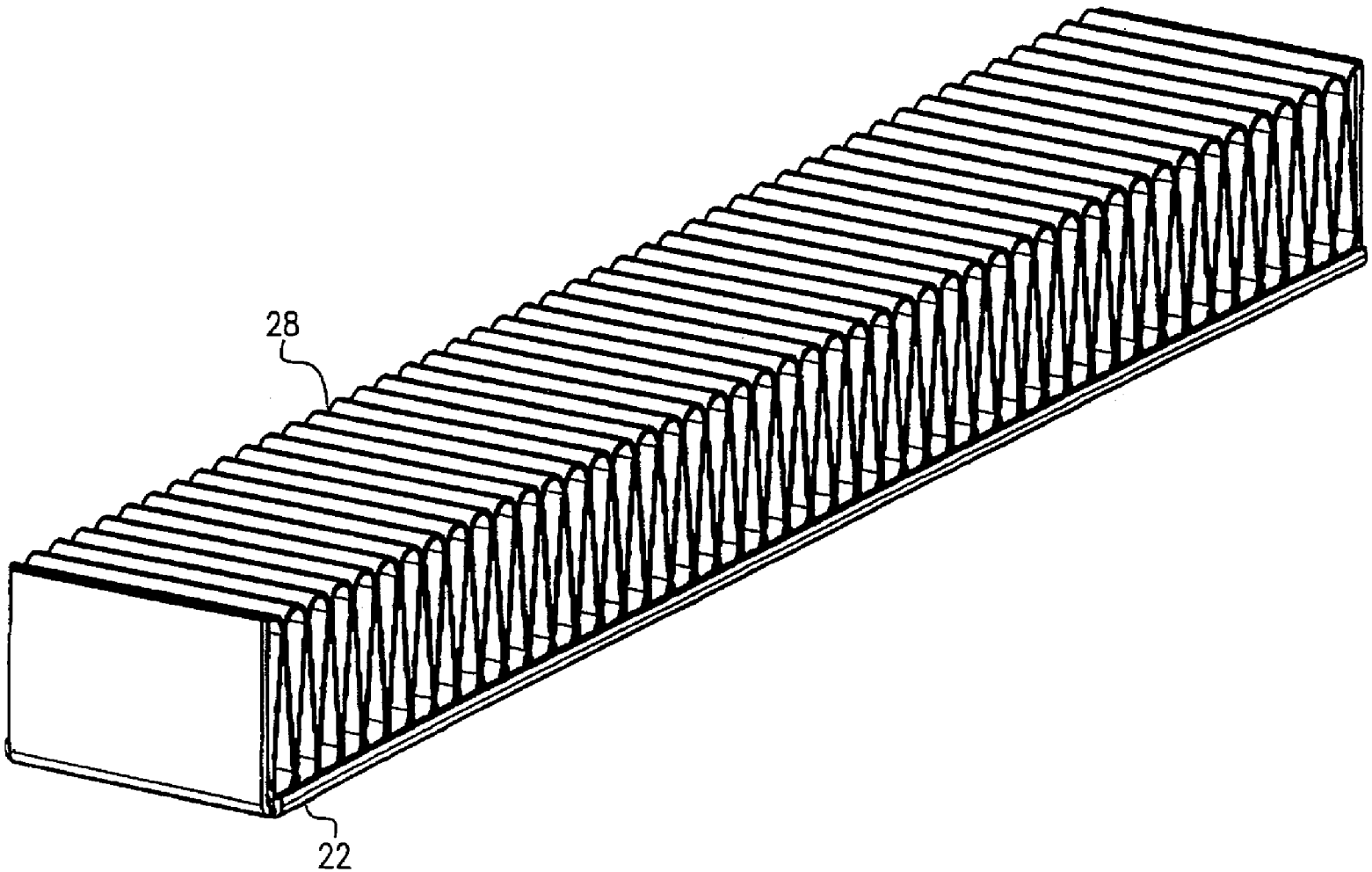
FIG. 1 shows a radiator element according to an embodiment.

FIG. 1 shows a radiator element for a heating device for heating the air according to a first embodiment. The radiator element comprises a lamella element 28 and a radiator sheet 22. In the arrangement shown in FIG. 1, all lamellae linearly contact the radiator sheet so that the function of the thermal conduction can optimally be fulfilled. The Lamella spacing may be between 1.8 to 2.0 mm. The radiator sheet 22 is folded on its end to form an end marking for the lamella element. On two parallel, opposing edges, the radiator sheet 22 has a projection 8 for attaching the lamella element 28 on the radiator sheet 22.

Figure 2A:
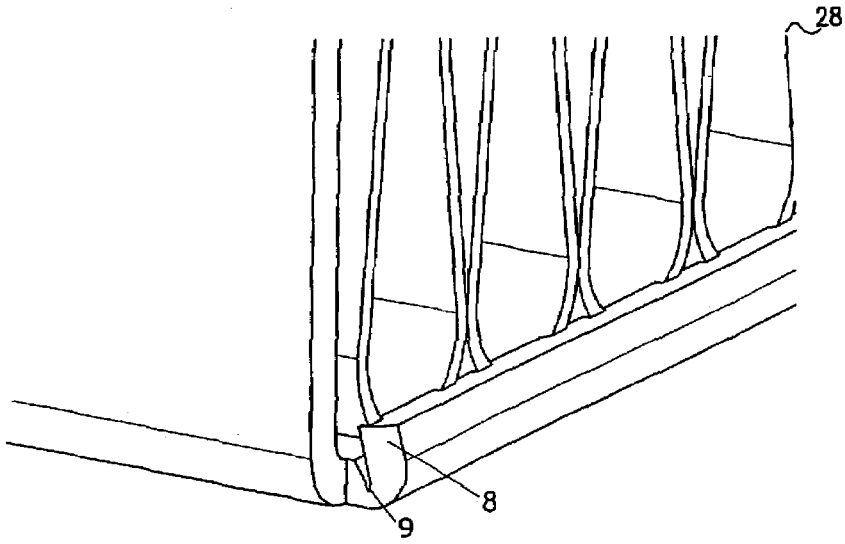
FIGS. 2*a* to 2*c* illustrate the connection technique for manufacturing the radiator element shown in FIG. 1.
Figure 2B:
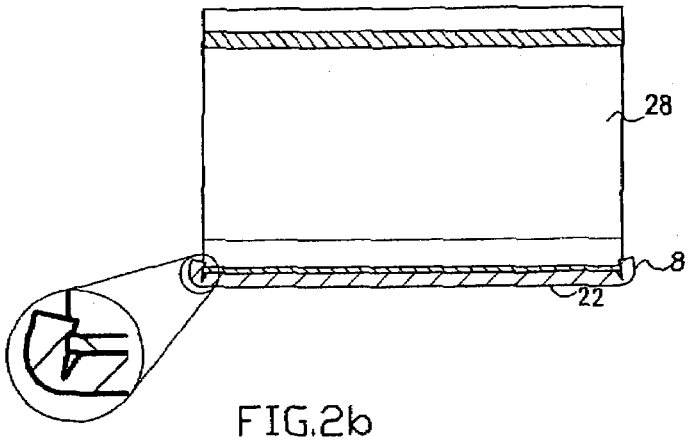
Figure 2C:
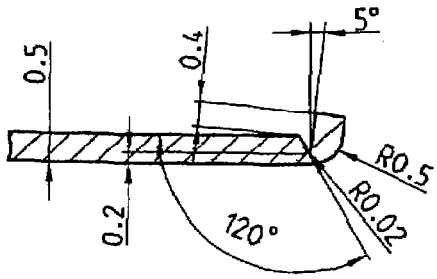

The projections in FIGS. 2*a*, 2*b* and 2*c* are further illustrated in a perspective 20 or cross-sectional view. They may be folded for attaching the lamella element 28, and for this purpose they comprise a notch 9 that may extend across the entire length of the radiator sheet 22. The notch 9 may have a depth of 0.3 mm, i.e. a depth of more than half of the radiator sheet thickness 0.5 mm. It may have been produced by a cutting or sawing process. Particularly, it may be rolled as will be further described below. The folding may be made by more than 90°, so that the folded projections also extend inwards. Further, the projections 8 may be made of deformable material so that they deform when contacting the lamella element 28, as may be seen in FIG. 2*a*.

In order to achieve during manufacture the above-mentioned linear contact of the lamellae on the radiator sheet 22, the projections may be formed to an U-like sheet open by approximately 5 degree after rolling in the notches on the longitudinal sides of the radiator sheet 22. This is shown in FIG. 2*c*. Subsequently, the lamella element would be inserted into the U-sheet which may be followed by the final pressing-on of the projections.

The projections 8 may have a first length along the respective edge and a 10 second length in the vertical direction towards the edge. The first length may be many times larger than the second length and may be made identical to the length of the edge of the radiator sheet 22 and/or of the lamella element 28. The second length may have 0.4 mm and may then lies in the range of the radiator sheet thickness.

A radiator element according to an embodiment can be manufactured by providing at least one lamella element and one radiator sheet, by setting the lamella element onto the radiator sheet and by folding the projections for fixing the lamella element. This may be made manually or by means of a machine. The manufacturing process may further include a step of making a notch.

First of all, lamellae are guided by a corrugated rib machine from an aluminum coil to a gear-like section rolling means. The lamella element can then be cut to the desired length by means of a counter means.

A further aluminum coil provides in a separate manufacturing step the strip 25 of a section rolling device used for the manufacture of the radiator sheet, said section rolling device containing the section rollers for rolling-in the notches. The device then carries out the embossing of the strip in a U-shape and cuts the strip to the predetermined length. The section and the U-embossing can also be made in a changed sequence. The prefabricated sheets can therefore be made without any cutting waste and they may subsequently be stacked in hoppers.

In a further process step, the Lamellae cut into length and the U-sheets are joined and fixed to each other by lateral pressing. Subsequently, the produced radiator element is stored in a container for further assembly. No new tool investments are required for different lengths. The prefabricated radiator elements are mechanically stable and may well be used for the automated construction of PTC radiators.

Further embodiments will now be explained in detail with reference to FIG. 3 10 to 10 in connection with corresponding position frames.

Figure 3:
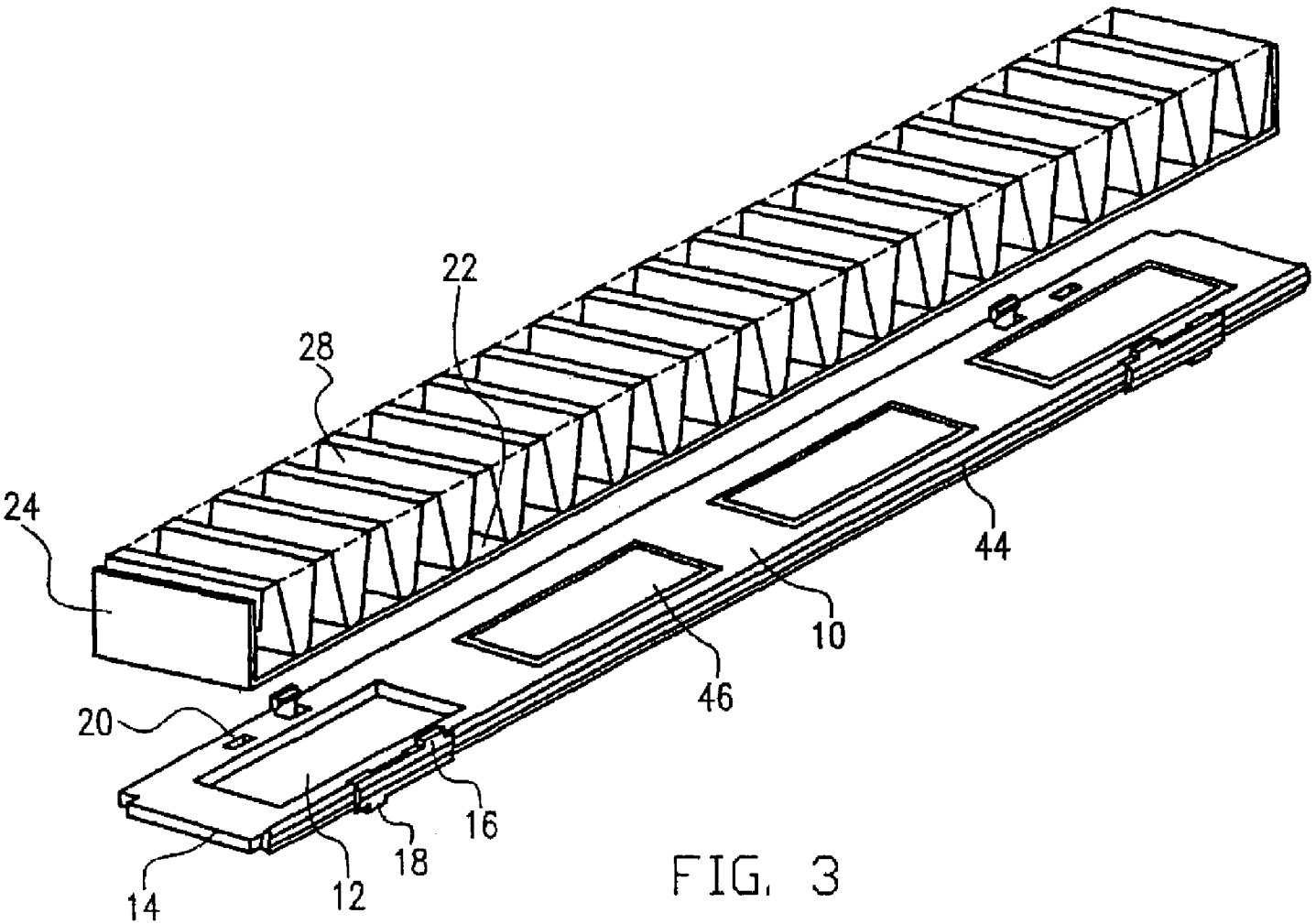
FIG. 3 shows a radiator element in another embodiment together with a position frame.

FIG. 3 shows a position frame with four recesses 12 for receiving PTC elements 46. Contrary to the view in FIG. 3, the amount of PTC elements per position frame can take any value. In particular, a position frame may also comprise six PTC elements. The recesses may be formed as break-through openings. They may, however, also be formed as recesses.

The position frame may consist of plastics, such as polyamide, and may be glass fiber reinforced to increase the mechanical stability.

Since low voltage PTC element with an operating voltage of e.g. 12 volts may have a thickness of 1.4 mm even 1.1 mm only, the position frames according to the embodiment are manufactured in the proximity of the recesses provided for the PTC elements with a thickness which is at least 0.1 mm smaller than the thickness of the PTC.

According to an embodiment, the length of the position frame may be approximately 240 mm.

The position frame 10 may comprise bulges 44 on its lateral edges, where the bulges allow for a noise-free air flow. Moreover, the front edges 14 may have bumpy bulges towards both sides of the position frame which are not shown in FIG. 3.

The position frame may further comprise clip elements having noses 16, 18 and recesses 20. In the embodiment of FIG. 3, the position frame has four such clip elements. The number of these clip elements may also deviate therefrom.

In an embodiment, each clip element may have two opposing noses 16, 18, which are arranged in a manner matching with the recesses 20. As the position frames themselves, the clip elements may also be made of plastics, such as polyamide. A manufacturing method used may be injection molding.

Radiator elements may be latched in a locking manner onto the position 10 frame by means of clip noses. A radiator element of this type was described above and is shown in a further embodiment of FIG. 3. It consists of a radiator element 22 and of a lamella element having a corrugated rib shape.

The radiator element 22 may comprise lamella end markings 24 on its front ends, said markings defining the length of the corrugated rib element. The radiator sheet has projections 8 for fixing the lamella element 28 on its lateral edges (not shown).

The radiator element may have the length and width of the position frame and a height of approx. 10 mm.

The radiator sheet and the corrugated ribs may be made of aluminum, which 20 is anti-corrosive and which has a high heat conductivity. In an alternative embodiment, the radiator element may also be made of brass.

Figure 4:
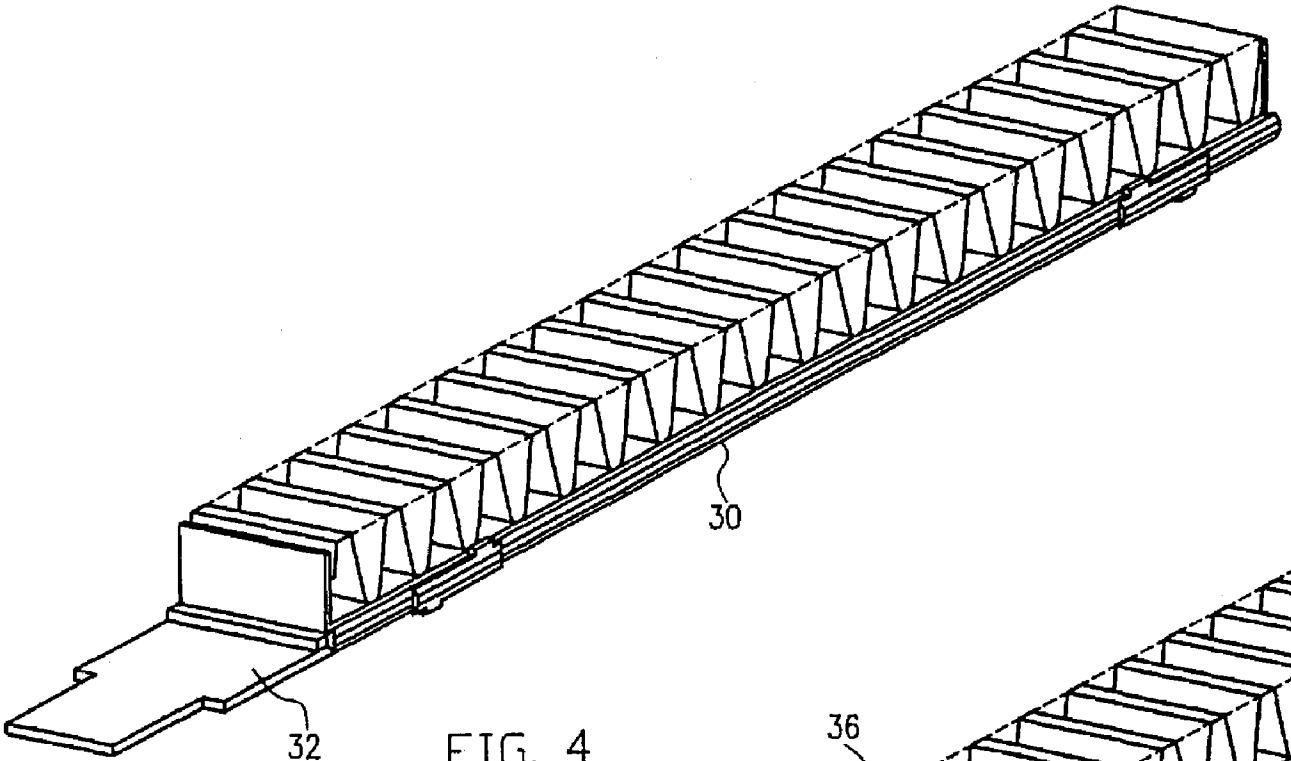
FIG. 4 shows a radiator unit of a position frame with the radiator element latched on one side of the embodiment of FIG. 3 and an electrode sheet latched on the other side of the position frame in a first embodiment.

FIG. 4 shows a prefabricated radiator unit, in which the position frame of FIG. 3 is locked to the radiator element of FIG. 3 and to which an electrode sheet 30 is additionally clipped on its other side. The electrode sheet 30 moreover comprises a terminal lug 32 on a front side. An electrical connection can advantageously established by this terminal lug. The electric terminals of the heating elements may be formed on the electrode sheet as welded terminals and as plug terminals. By avoiding rivet connections, a power supply up to a high power can be carried out. A power of e.g. 160 A is possible.

Contrary to the embodiment shown in FIG. 4, a position frame may also be connected on both sides with lamella elements. Furthermore, it is possible to provide a position frame on both sides with identical or different electrode sheets. Electrode sheets may also be connected to the lamella elements without position frames on the upper side of the lamella elements.

Figure 5:
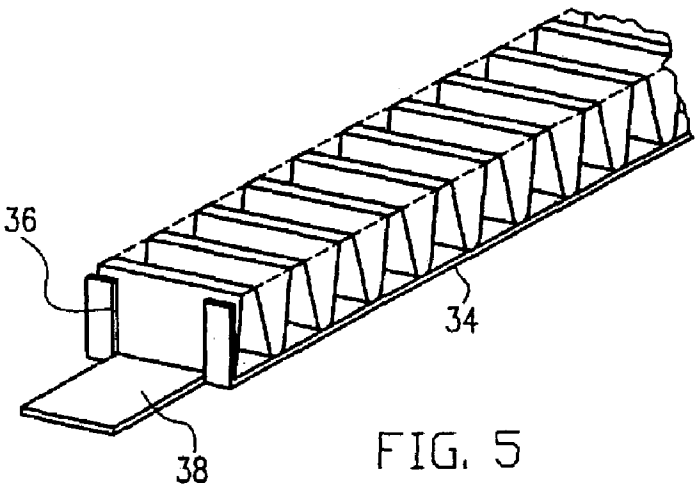
FIG. 5 illustrates another embodiment of a radiator element.

FIG. 5 shows a further embodiment of a radiator element, in which the radiator sheet 34 also takes over the function of an electrode sheet. For this purpose, the lamella end marking 36 is integrally connected to an electric terminal lug 38.

Figure 6A:
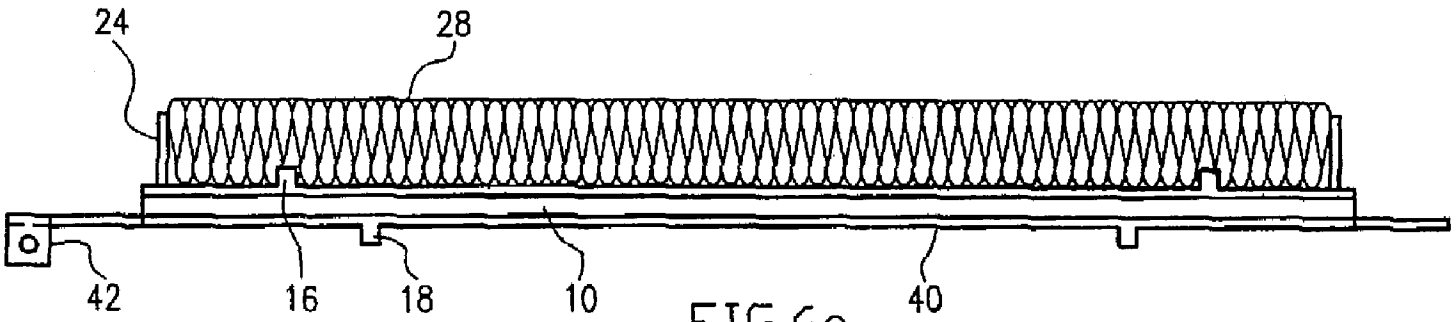
FIG. 6*a* is a lateral view of a radiator unit designed according to an embodiment, comprising a position frame, a radiator element and an electrode sheet.
Figure 6B:
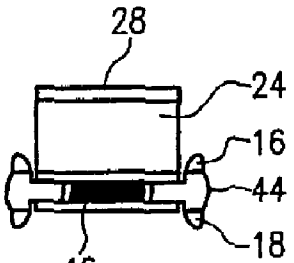
FIG. 6*b* shows a radiator unit designed according to an embodiment, comprising a position frame and a radiator element in front view.
Figure 6C:
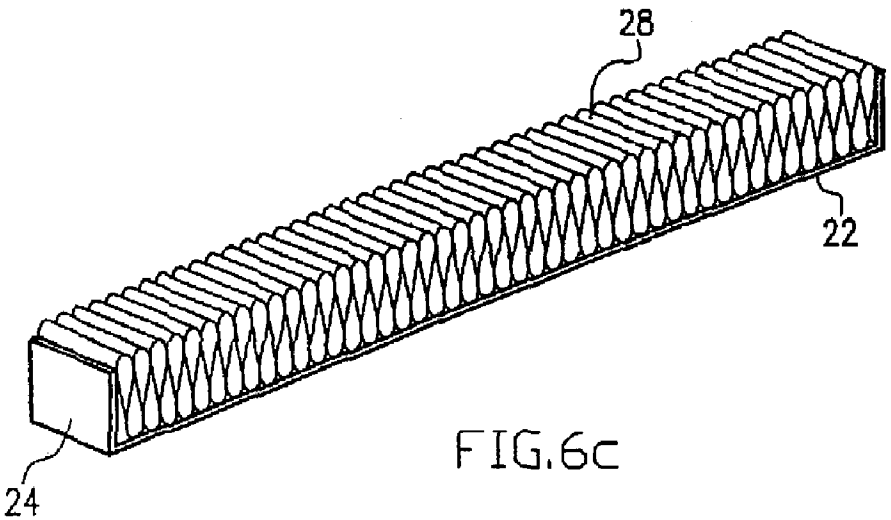
FIG. 6*c* shows the further embodiment of the radiator element.

FIG. 6*a* shows an arrangement similar to that of FIG. 4. However, the corrugated ribs of the lamella element 28 are set in a more dense way. Moreover, the electrode sheet is provided with an angled terminal lug. The arrangement of FIG. 6*a* without angled terminal lug can be seen in the front view of FIG. 6*b*. FIG. 6*c* shows the radiator element of FIG. 6*a* in a separate view.

Figure 7:
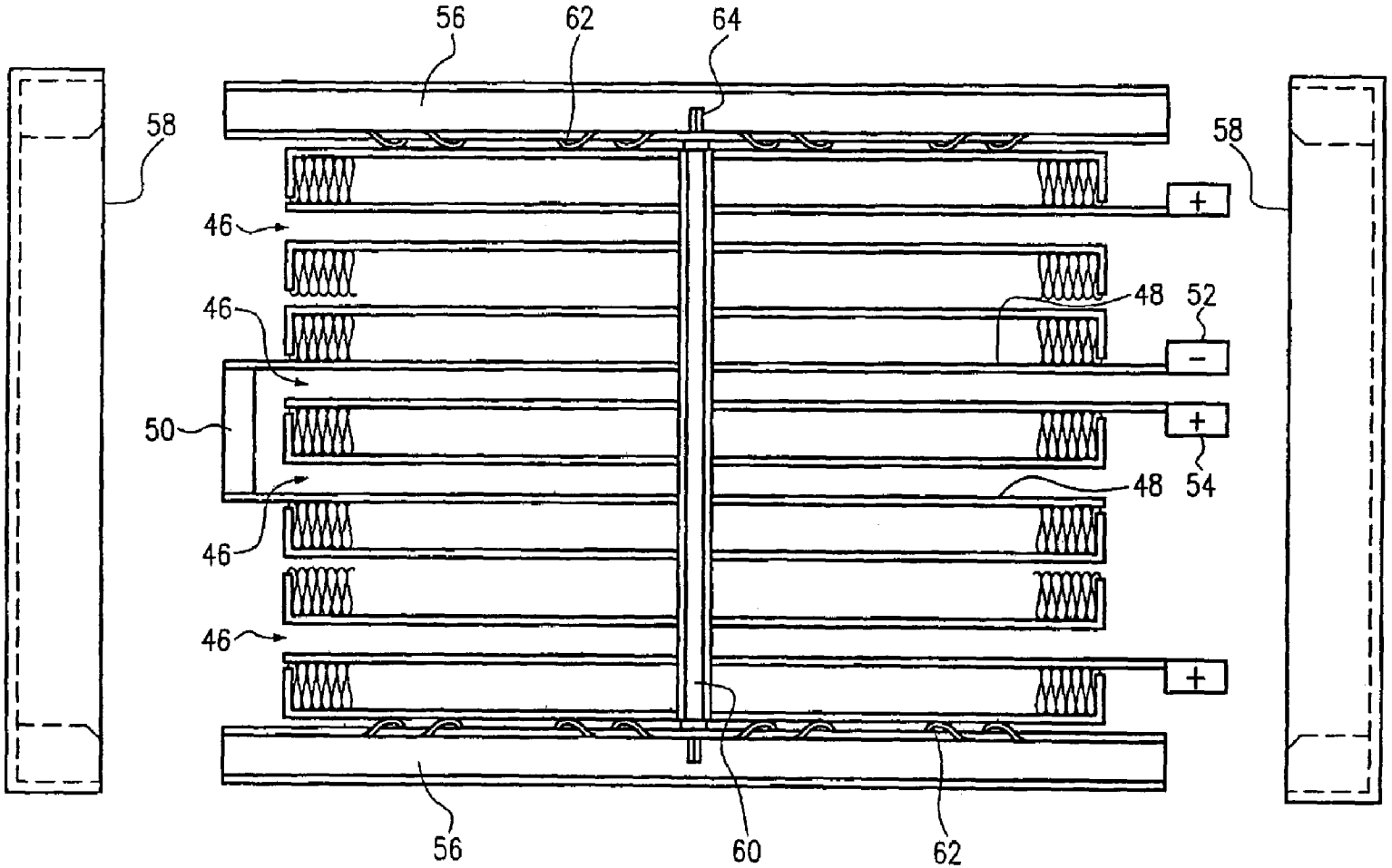
FIG. 7 shows a heating device according to a first embodiment.
Figure 8A:
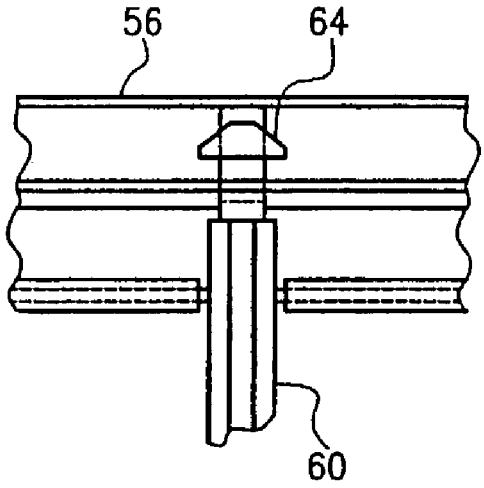
FIGS. 8*a* and 8*b* illustrate in a lateral and front view the joining mode between the holding bracket and the strap by means of holding flaps.
Figure 8B:
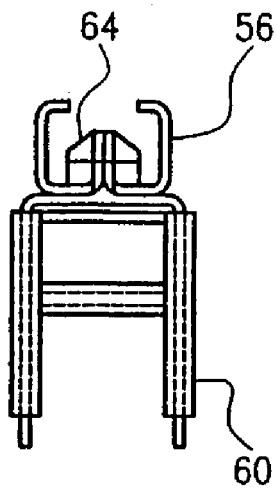
Figure 8C:
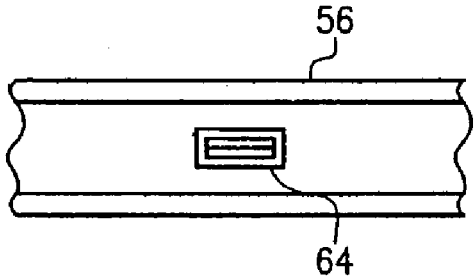
FIGS. 8*c* and 8*d* illustrate in a top view the rotatability of the holding flap.
Figure 8D:
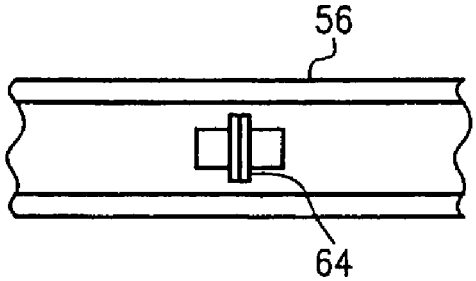

FIG. 7 shows a first embodiment of the heating device. The device comprises a lamination of stacking of prefabricated radiator units, which form a total of three heating stages. In this embodiment, an overall efficiency of 1000 W is predefined. Other embodiments have PTC elements with an overall efficiency of up to 2000 W.

In the embodiment of FIG. 7, the outer heating stages have one PTC row only, whereas the middle heating stage has two PTC rows. The terminal lugs 54 provided with "+" are the electric power supplies of the individual heating stages, wherein the terminal lug 52 marked by "−" represents the ground connection.

To enable a flexible positioning of the radiator unit, the heating device of FIG. 7 has a two-piece electrode sheet whose two sheets 48 are connected by means of a bridge 50.

The laminated radiator units are bordered on both sides by straps 56, 5 wherein springs 62 between the brackets and the upper or lower radiator unit provide the required high spring force. Straps are particularly sensible with position frames that border four or more PTC elements. In the case of especially long straps, a centrally attached holding bracket 60 may be provided, which may be formed of precious steel and which is formed in an electrically insulated manner. On its ends the holding bracket 60 comprises rotatable holding flaps 64 that are inserted for assembly by suitable, potentially rectangular openings in the straps 56 and which after the exertion of pressure onto the straps are rotated by 90°. The straps 56 are further laterally stabilized by sleepers 58 which may be made of plastics.

FIGS. 8*a* to 8*d* illustrate in detailed manner the joining technique between the holding bracket 60 and the strap 56 by means of the rotatable holding flap 64. The holding flap 64 is rotated on its upper part, which reveals transverse noses, by 90° by means of a rotary cylinder. The holding bracket and the strap may be formed as U-shaped hollow profiles. A cross section of the holding bracket may be of approximately 5×0.5 mm.

Figure 9:
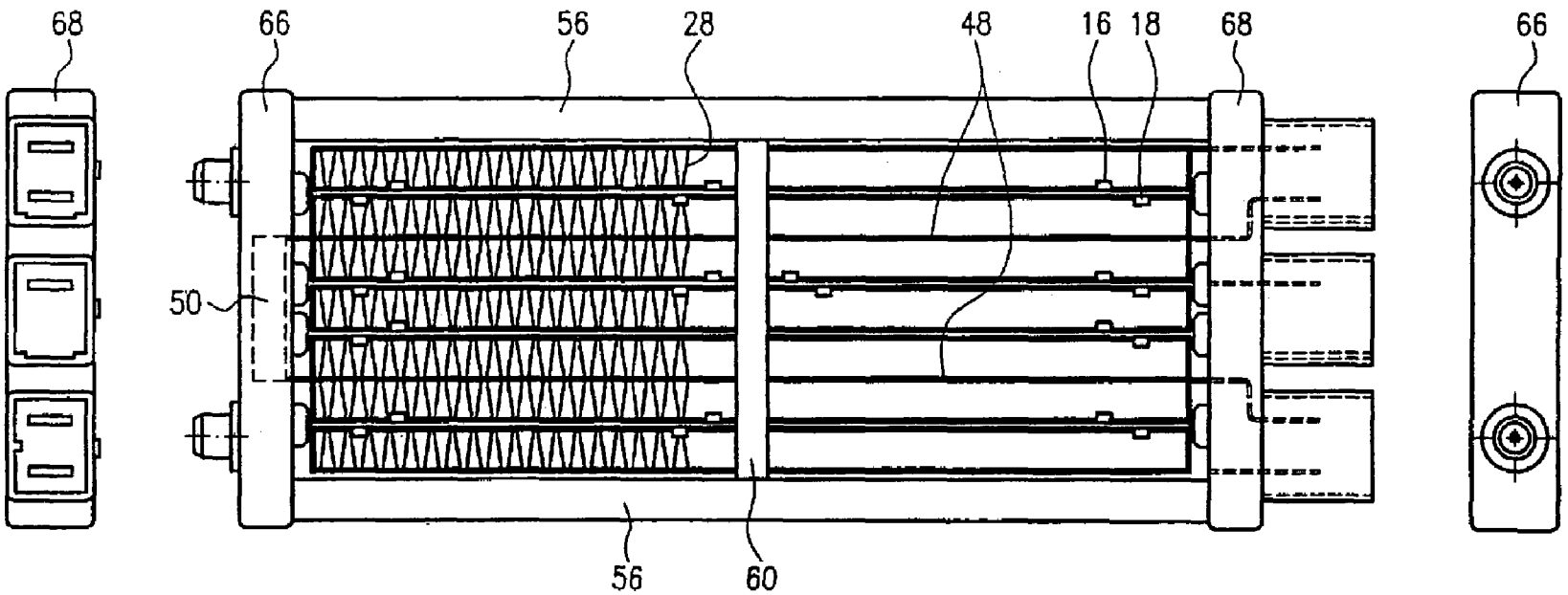
FIG. 9 shows a second embodiment of the heating device.

FIG. 9 shows a second embodiment of a heating device that differs from the embodiment shown in FIG. 7 mostly by the number and type of radiator units. Moreover, the lateral sleepers 66, 68 are provided with suitable mechanical or electrical supports.

Figure 10:
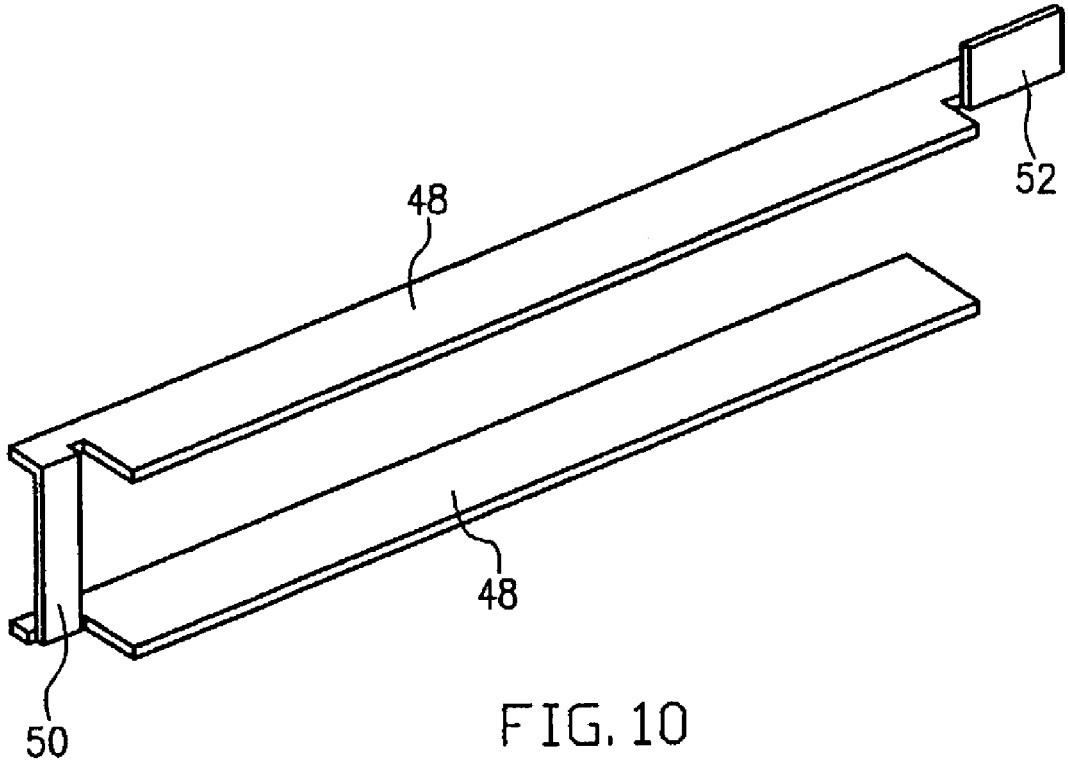
FIG. 10 is a perspective view illustrating a two-piece electrode sheet having a connecting bridge and an angled terminal lug.

FIG. 10 shows in a perspective view a two-piece electrode sheet 48 having a connecting bridge 50 and an angled terminal lug 52. The two-piece electrode sheet is particularly provided for arrangements in which only one ground or current supply terminal is used.

As may be seen from the above description, the design of the radiator element according to the embodiment leads to a simplified assembly of heating devices. First of all, radiator units may be formed in that position frames are connected with radiator elements and/or electrode sheet to an extent that is necessary for the heating device. The radiator elements can also be joined amongst each other. Furthermore, different radiator elements may be used, which for instance differ from each other by the design of the radiator sheets and which can also take over functions of electrode sheets.

The prefabricated radiator units are subsequently laminated and bordered by 10 straps. In an embodiment, one or a plurality of holding brackets are attached. Finally, the overall arrangement is fixed by lateral sleepers.

The embodiments are advantageous since they use radiator elements that are formed of a radiator sheet and of a lamella element. The corrugated rib shape of the lamella elements can be manufactured at a low price, may lead to a low overall weight and may, due to the channels formed through these elements and the large surface of the lamella elements, enable an improved thermal output to the air flowing through the channels.

The notching of the projections facilitates the folding process, since the nothing leads to a displacement of material, which makes it possible that material crush does not occur when pressing the projections onto the lamella element inserted. A material crush or a piling up of material in this bending portion would prevent the planar contact of the Lamellae on the sheet so that the lamellae cannot safely be held when laterally pressing on the projections.

In particular in the case of low leg heights of approximately 0.4 mm, the notching technique according to the embodiments is advantageous, since otherwise respective foldings can only be carried out with the greatest effort.

The notching of the projections further enables the use of more simple tools and tool machines. This significantly improves the assembly properties. Moreover, offcut is avoided.

Moreover, the elongated shape of the projection additionally creates the 5 advantage of an improved strength of preassembled units. Furthermore, a safe thermal contact between the lamella element and the radiator element is enabled in this manner so that the desired thermal output can reliably be achieved and maintained. Moreover, the advantage is achieved that the assembly of the radiator elements can be implemented quickly, in an automated manner and thus also in an inexpensive manner. This technology is particularly advantageous in the case of heating elements that are very large.

A formation of the projections across the entire length of the radiator sheet or the lamella element leads to an especially stable and also compact unit. Moreover, the risk of injury during assembly is reduced, since no or only slightly projecting elements exist.

If the notch has a length that corresponds to the length of the edge of the radiator sheet, lateral forces or shear forces do particularly not occur which could lead to a distortion of the radiator sheet during the folding process.

A notch is especially advantageous if it is deeper than half the sheet thickness, since in this manner the displacement of material during the folding process is implemented to an especially suitable extent.

An especially advantageous mode of assembly can be achieved if the length of the projection perpendicular with respect to the extension of the edge, i.e. the projection length to be folded, is in the scale of the thickness of the radiator sheet. Furthermore, the assembly properties with respect to the unit strength to be obtained and the material consumption are optimally weighed. An especially advantageous projection length is 0.4 mm at a sheet thickness of 0.5 mm.

If the projections are folded before inserting the Lamella element in a manner that a slightly opened U-sheet is produced, the advantage of a further improved assembly safety is achieved, since when pressing on the projections for fixing the Lamella element, the parts cannot slip with respect to each other. An especially advantageous opening angle proved to have a value of approximately 5 degree.

Further advantages can be achieved if the projections are folded by more than 90 degrees during the press-on process. In this case, a precise adjustment of the bending forces is not required, wherein a safe support of the lamella element can still be obtained.

If the lamella element comprises a plurality of lamellae arranged in a meander-like manner, and if it is attached to the radiator sheet in a manner that two neighboring Lamellae each contact each other, an identical amount of meanders (or lamellae or corrugated ribs) can be arranged over a PIG element. The number of meanders, which contact in the area of the PTC heating element, is decisive for the thermal efficiency and thus also for the thermal output. Hence, the operational reliability of the heating device is advantageously increased by an arrangement of this type.

Further advantages can be obtained in connection with position frames, 20 which will be described further below. If a position frame is used which enables to snap or clip radiator elements on position frames, i.e. to connect them in a locking manner, prefabricated units are produced, which can easily be handled without special care. Since these prefabricated units also comprise the radiator elements, the number of the parts required for assembly of the heating device is reduced. These few prefabricated radiator units can subsequently easily and quickly be stacked by hand. Thus, the embodiments are especially advantageous with thin PTC elements, which have a thickness of approximately 1.1 mm and which require special manual care in conventional arrangements.

A further advantage of this arrangement is the avoidance of riveted connections not only with the assembly of radiator elements but also as a result of the locking connection of the radiator element. Rivet connections in energized parts lead to a contact resistance that can lead to failure of the heating element. Rivet connections of different materials are especially problematic. A rivet-less arrangement is especially advantageous in heating elements with large thermal output (1,500 watts, 12 volts/125 amperes), in which the conduction of current has a special meaning. The avoidance of rivet connections especially in heating elements having one ground connection only is also advantageous, since the entire heating current is introduced via one single rivet connection in corresponding conventional arrangements.

Clip noses and corresponding recesses in the position frame allow in an advantageous manner the assembly of the radiator element in a manner safe in position and fixed against torsion.

A design of the position frame that allows the two-sided clip-on of radiator elements, leads to a simplified mountability, since the overall number of parts required for assembling the heating device is further reduced.

The possibility of latching one-sided or two-sided electrode sheets instead of 20 radiator elements, allows the prefabrication of a plurality of different radiator units and further increases the suitability for assembly.

The design of the electrode sheets with terminal lugs allows a plurality of connection techniques for the electrical current supply. Angled terminal lugs for welded connections and for plug connections are advantageous.

The use of two-sided electrode sheets, which are connected through a bridge, additionally simplifies by the provision of especially large prefabricated radiator units, the overall assembly of the heating device and moreover enables the joining of electric terminals for a plurality of position frames.

The position frame may comprise breakthroughs for receiving the at least one PTC element. These breakthroughs can be manufactured in an inexpensive manner and they may contribute to weight reduction.

If the position frame has bulges on its front sides, the position safety of the 5 radiator element is further increased. Bulges of the front face and of the side edges of the position frame moreover lead in an advantageous manner to a noise-free bypass of the air flow.

If the position frame is made of glass fiber reinforced polyamide, the advantages of a high stability and high temperature resistance are combined with the favorable properties of the precise manufacturability and low thermal expansion.

Advantages are further produced by the lamella end marking of the radiator sheets, since thereby the lamella elements are restricted in their longitudinal extension.

If such a lamella end marking is provided with an electric terminal, this leads to the special advantage that the radiator sheet can additionally in a simple manner be used for supplying power, which further increases the combination possibilities of prefabricated units in the assembly of the heating device.

If the prefabricated units are bordered by a holding frame consisting of straps and sleepers, the final assembly of the heating device is decisively enhanced in an advantageous manner. A heating device is particularly created which can be manufactured mostly without expensive screw or rivet connections.

Springs connected to the straps lead in an especially suitable manner to a stable arrangement, whose elements are positioned in a manner safe against being displaced. The operational safety is also increased, since the pressure required for contacting the PTC elements is permanently ensured.

An additional holding sleeper further reinforces the overall arrangement and therefore allows in an advantageous manner the use of further increased spring forces.

If the holding brackets are fixed in the straps by means of holding flaps that 5 can be rotated, this leads to the advantage of an improved assembly technique.

While the invention has been described with respect to the physical embodiments constructed in accordance therewith, it will be apparent to those skilled in the art that various modifications, variations and improvements of the present invention may be made in the light of the above teachings and within the purview of the appended claims without departing from the spirit and intended scope of the invention. In addition, those areas in which it is believed that those of ordinary skill in the art are familiar, have not been described herein in order to not unnecessarily obscure the invention described herein. Accordingly, it is to be understood that the invention is not to be limited by the specific illustrative embodiments, but only by the scope of the appended claims.

What is claimed is:

1. A radiator element for use in an air heating device, comprising:

at least one lamella element comprising a plurality of lamellae arranged in a meander-like manner; and a radiator sheet having a bottom, two opposing lateral sides, a first end, and second end, the first and second ends each extending substantially perpendicular to the bottom and defining a lamella end marking, the lamella end markings defining a length of the lamella element, wherein said radiator sheet comprises projections extending from the two opposing lateral sides and completely extending between the first end and the second end for the purpose of attaching said lamella element to said radiator sheet prior to assembly of the air heating device, wherein each of the projections has a first length along the respective lateral side and a second length in a vertical direction, and wherein the first length is a multiple of the second length, wherein each of said projections comprises a groove extending between the first end and the second end, the groove defining a first portion of the projection and a second portion of the projection, the second portion configured to fold at the groove by more than 90° in a single direction with respect to the first portion, the second portion deforming when pressed into the lamella element.

2. The radiator element as claimed in claim 1, wherein the second length of the projections in the folded state is of approximately 0.4 mm.

3. The radiator element as claimed in claim 1, wherein the lamella element is attached at the radiator sheet in a manner so that neighboring lamellae contact each other.

4. A heating device for heating air, having a radiator element comprising:

a position frame including a plurality of recesses;

a radiator element configured to be received within one of the recesses, the radiator element including at least one lamella element comprising a plurality of lamellae arranged in a meander-like manner; and a radiator sheet having a bottom, two opposing lateral sides, a first end, and second end, the first and second ends each extending substantially perpendicular to the bottom and defining a lamella end marking, the lamella end markings defining a length of the lamella element, wherein said radiator sheet comprises projections extending from the two opposing lateral sides and completely extending between the first end and the second end for the purpose of attaching said lamella element to said radiator sheet prior to assembly of the air heating device, wherein each of the projections has a first length along the respective lateral side and a second length in a vertical direction, and wherein the first length is a multiple of the second length, wherein each of said projections comprises a groove extending between the first end and the second end, the groove defining a first portion of the projection and a second portion of the projection, the second portion configured to fold at the groove by more than 90° in a single direction with respect to the first portion, the second portion deforming when pressed into the lamella element.

5. The heating device as claimed in claim 4, wherein the second length of the projections in the folded state is of approximately 0.4 mm.

6. The heating device as claimed in claim 4, wherein the lamella element is attached at the radiator sheet in a manner so that neighboring lamellae contact each other.

7. A method for manufacturing a radiator element for use in an air heating device, the method comprising:

providing at least one lamella element comprising a plurality of lamellae arranged in a meander-like manner;

providing a radiator sheet having a bottom, two opposing lateral sides, a first end and a second end, the first and second ends extending substantially perpendicular to the bottom and defining a first and a second lamella end marking, wherein the first and second lamella end markings define a length of the lamella element and in which the radiator sheet comprises projections extending from the two opposing lateral sides and completely extending between the first end and the second end for attaching said lamella element to said radiator sheet prior to assembly of the air heating device, wherein each of the projections has a first length along the respective lateral side and a second length in a vertical direction, and wherein the first length is a multiple of the second length;

providing at least one groove on said projections extending between the first end and the second end, the groove defining a first portion of the projection and a second portion of the projection, the second portion configured to fold at the groove;

applying said at least one lamella element onto the radiator sheet; and folding the second portion of the projections by more than 90° with respect to the first portion of the projections into said lamella element until the second portion of the projections is deformed and pressed laterally against two opposing sides of said lamella element.

8. The method as claimed in claim 7, wherein the step of putting said at least one lamella element onto said radiator sheet comprises:

forming a slightly opened U-sheet by folding the projections; and inserting said at least one lamella element into the U-like sheet.

9. The method as claimed in claim 8, wherein the opening degree of said slightly opened U-sheet is approximately 5 degree.

10. The method as claimed in claim 7, wherein the second length of the projections in the folded state is of approximately 0.4 mm.

11. The method as claimed in claim 7, wherein the lamella element is attached at the radiator sheet in a manner so that neighboring lamellae contact each other.

* * * * *

UNITED STATES PATENT AND TRADEMARK OFFICE

CERTIFICATE OF CORRECTION

PATENT NO. : 7,482,557 B2
APPLICATION NO. : 10/338988
DATED : January 27, 2009
INVENTOR(S) : Clemens David It is certified that error appears in the above-identified patent and that said Letters Patent is hereby corrected as shown below:

Title page, item [75] delete Inventor "David Clemens"

and insert --Clemens David--.

Signed and Sealed this
Third Day of July, 2012

David J. Kappos

David J. Kappos
*Director of the United States Patent and Trademark Office*